US005417435A

United States Patent [19]

Peretz

[11] Patent Number: 5,417,435

[45] Date of Patent: May 23, 1995

[54] COIN OPERATED PROJECTING AND TARGET AMUSEMENT DEVICE

[76] Inventor: David A. Peretz, 4801 Hollywood Blvd., Hollywood, Fla. 33021

[21] Appl. No.: 248,677

[22] Filed: May 25, 1994

[51] Int. Cl.[6] ..... A63F 9/02

[52] U.S. Cl. ..... 273/355; 273/399

[58] Field of Search ..... 273/355, 356, 398, 399, 273/440, 447, 457

[56] References Cited

U.S. PATENT DOCUMENTS

| | | | |
|---|---|---|---|
| 2,192,096 | 12/1938 | Minger . | |
| 2,520,460 | 8/1950 | Ford | 273/355 X |
| 3,724,855 | 4/1973 | Chu . | |
| 3,794,325 | 2/1974 | Stender . | |
| 4,089,525 | 5/1978 | Palazzolo | 273/375 |
| 4,245,842 | 1/1981 | Kuna et al. | 273/357 |
| 4,303,248 | 12/1981 | Shoemaker, Jr. et al. | 273/356 |
| 4,371,171 | 2/1983 | Silverman et al. | 273/399 X |
| 4,487,414 | 12/1984 | Karkkainen et al. | 273/371 |
| 4,496,160 | 1/1985 | Wichinsky et al. | 273/369 |
| 4,744,566 | 5/1988 | Malavazos | 273/399 X |
| 4,759,551 | 7/1988 | Crompton | 273/355 |

*Primary Examiner*—William H. Grieb

*Attorney, Agent, or Firm*—Longacre & White

[57] ABSTRACT

An amusement apparatus wherein a catapult mechanism projects objects toward various targets, and in particular to an amusement game in which a catapult is lever activated and receives coins via a chute arrangement. The user controls the lever to catapult objects to various targets within the game playing area. The arrangement of the coin entry mechanism, the chute, the self aligning projectile receptacle, and the flipping mechanism provide a constant locating mechanism which ensures accurate locating of the objects to the flipping mechanism.

23 Claims, 5 Drawing Sheets

COIN OPERATED PROJECTING AND TARGET AMUSEMENT DEVICE

BACKGROUND OF THE INVENTION

1. Field of the Invention

The present invention relates to an amusement game wherein a catapult mechanism projects objects toward various targets within an enclosed playing area, and in particular to an amusement game in which a catapult is lever activated and receives coins via a chute arrangement. The user controls the lever to catapult objects to various target within the game playing area. The arrangement of the coin entry mechanism, the chute, the self aligning projectile receptacle, and the flipping mechanism provide a constant locating mechanism which accurately locates the objects on the flipping mechanism, and the flipping mechanism permits various angles of trajectory.

2. Description of Related Art

Various amusement games are known in which a player tosses objects toward various targets. Many of these games simulate actual athletic games, and employ a tossing objective.

U.S. Pat. No. 4,089,525 to Palazzolo discloses a basketball game requiring the player to operate a ball thrower arm lever which throws a ball toward a basket. Means are provided for returning the ball to the ball thrower lever arm. A funnel arrangement aligns the ball on the lever arm for subsequent shots, and scoring mechanism tracks successful shots.

U.S. Pat. No. 3,794,325 to Stender discloses an aerial bowling game having a target assembly with open receptacles arranged in a tenpin configuration and an upright backboard to deflect the projectile into a desired receptacle. The catapult mechanism provides a projectile launcher with preselected and adjustable launching forces. However, the catapult mechanism of U.S. Pat. No. 3,794,325 must be manually loaded by the player.

U.S. Pat. No. 4,496,160 to Wichinsky et al. discloses a coin projecting and target game apparatus wherein a projecting mechanism shoots coins into a playing area. Pusher means are also provided to push collecting pieces of a shelf configuration. The projecting mechanism of U.S. Pat. No. 4,496,160 includes a rotatable flipper driven by belts and motors. Thus, the player does not control the force of the projecting mechanism, and the flipper mechanism is loaded as coin fall from the shelf configuration.

In addition, the prior art fails to teach a mechanism for varying the trajectory of the projectile for tossing whereby both a long, low trajectory for distant targets or a shorter, higher trajectory for closer targets.

The need exist for a coin tossing game wherein the tossing ability and accuracy of the player is paramount, and wherein the coin entry mechanism provides a constant locating mechanism for consistent and accurate location of the projectile to be flipped or tossed.

SUMMARY OF THE INVENTION

It is the object of the instant invention to provide a coin chute, a self aligning projectile receptacle, and catapult mechanism which sets a coin or other projectile up for tossing at various targets. The invention uses the combination of a catapult for tossing projectiles toward a target wherein the structural arrangement of the chute, projectile stop, self aligning projectile receptacle, and catapult mechanism provides a means for continuously and accurately aligning a series of projectiles for tossing.

It is further the object of the invention to provide a coin tossing apparatus wherein a chute and catapult mechanism accurately aligns a coin on a catapult formed for tossing.

It is further the object of the invention to provide an apparatus wherein the player controls the catapult positioning and tossing force to skillfully toss the coin toward various targets. The player is awarded according to the number of successful shots.

It is also the object of the invention to provide a flipping mechanism which adjusts the angle of trajectory in order to provide both a high, short trajectory and a longer, lower trajectory according to the player's control.

For the invention, a handle or plunger projects from a closed playing area in which the projectiles and targets are located. The plunger is pushed down by the player and released at different release points to vary the tossing force of the catapult mechanism.

The invention will now be described by way of example with reference to the accompanying drawings which illustrate a preferred embodiment of the invention. It is to be understood that the following drawings are in no way intended to limited the spirit and scope of the invention.

DESCRIPTION OF PREFERRED EMBODIMENT

Figure 1:
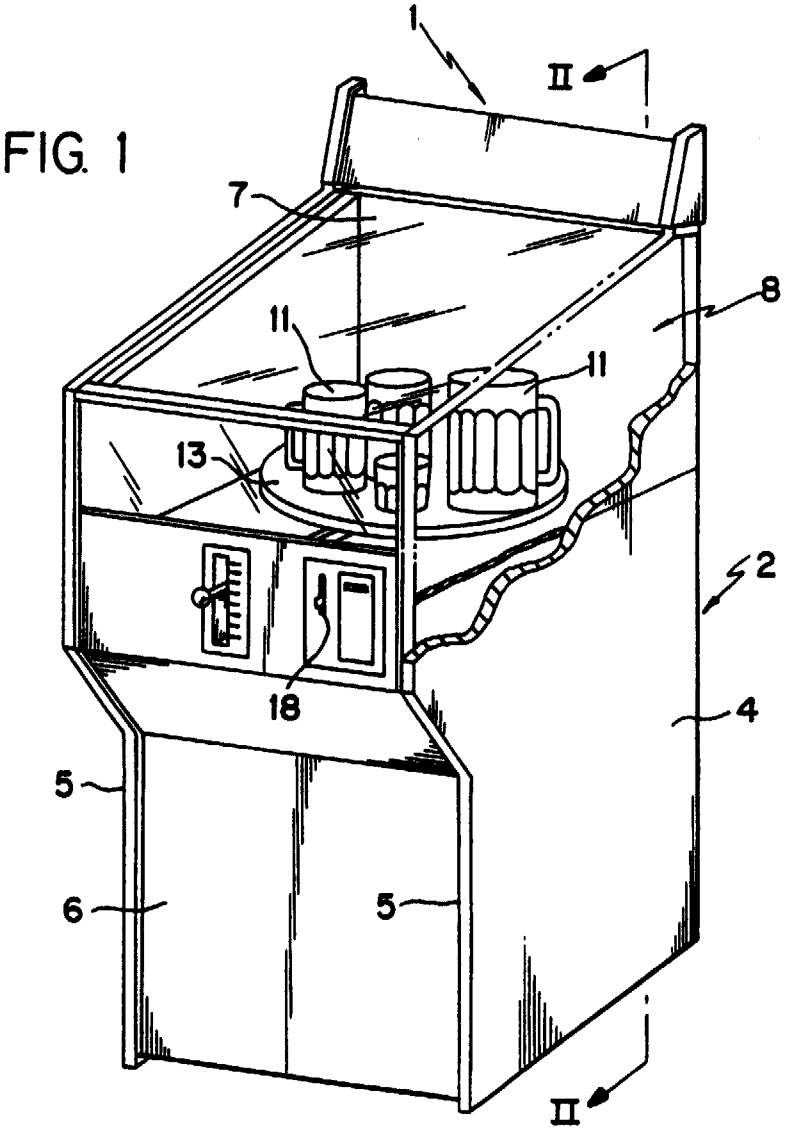
FIGS. 1 and 1*a* are perspective views of preferred embodiments of the apparatus with closed cabinet defining the playing area.

With reference to FIG. 1, the game apparatus 1 is illustrated comprising a cabinet 2 with a base portion 4 and a playing area 8. The base portion 4 comprises side walls 5 front section 6, and a backboard 7 extending into the playing area 8. The base portion provides support and foundation for the playing area 8. Unsuccessful tosses are collected in a suitably formed collection section both in the playing area and base portion 4 for removal at a later time.

The playing area 8 is formed of various suitable dimensions depending on the playing layout. The playing layout illustrated in FIG. 1 comprises a series of mugs/cups 11 situated on a turntable 13. In the preferred embodiment, the turntable 9 and mugs/cups 11 rotate during play to increase the skill level necessary to make a successful toss.

Figure 1A:
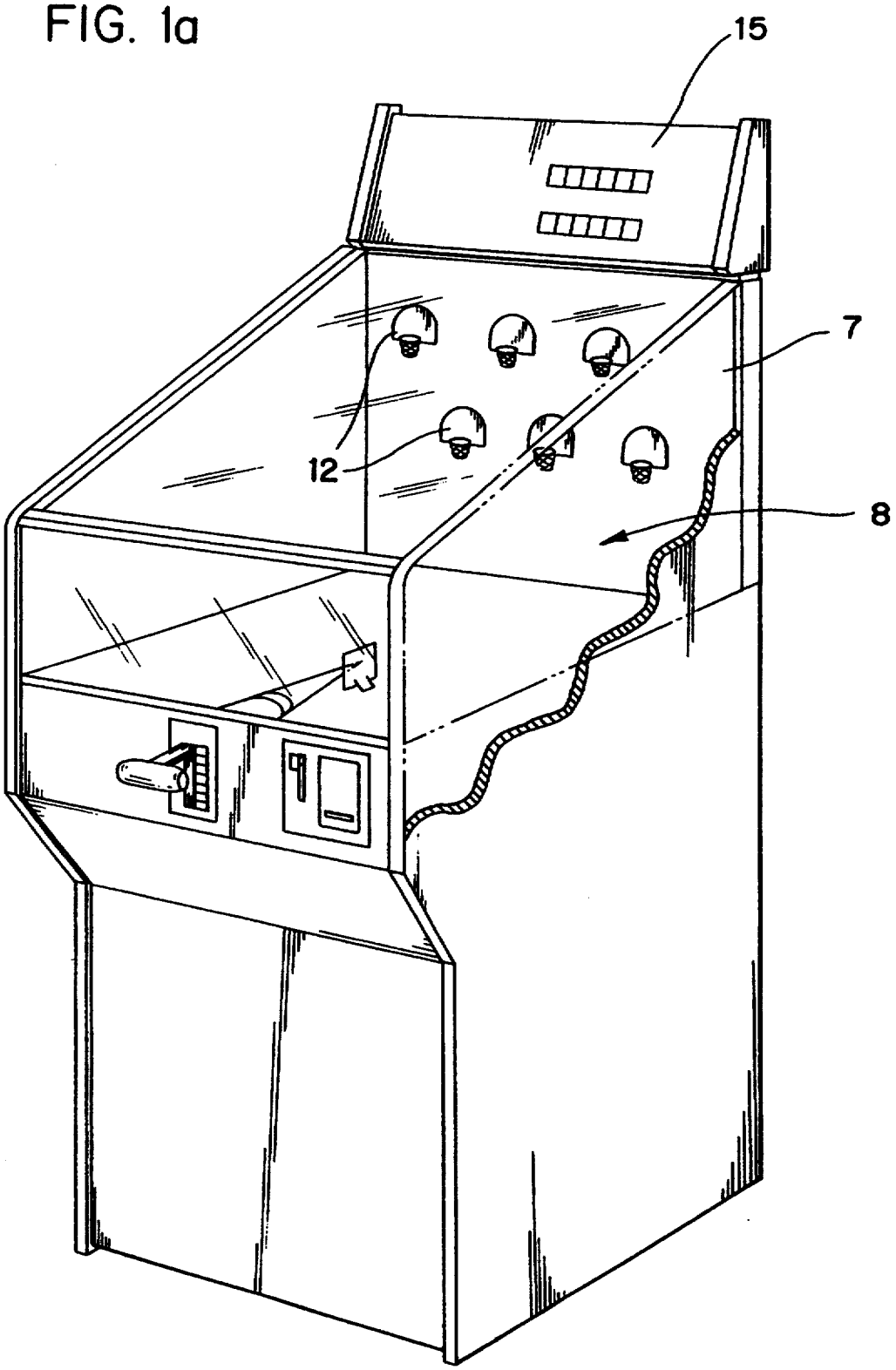

It should be understood that the playing layout of FIG. 1 is provided for illustrative purposes only. For example, FIG. 1*a* illustrates an alternate playing layout wherein the catapult mechanism tosses the projectile toward a series of baskets 12 mounted on the backboard 7 of the playing area 8.

Scoring for successful shots is maintained by an electronic scoreboard situated at display area 15 above the playing area 8. Scoring may be kept by any known electronic or digital scoring system previously known in the art. For example, each of the baskets/targets 12 may include a switch (not shown) which will be activated by a coin passing through the basket so that an appropriate reward may be awarded as will be explained more fully below.

Figure 2:
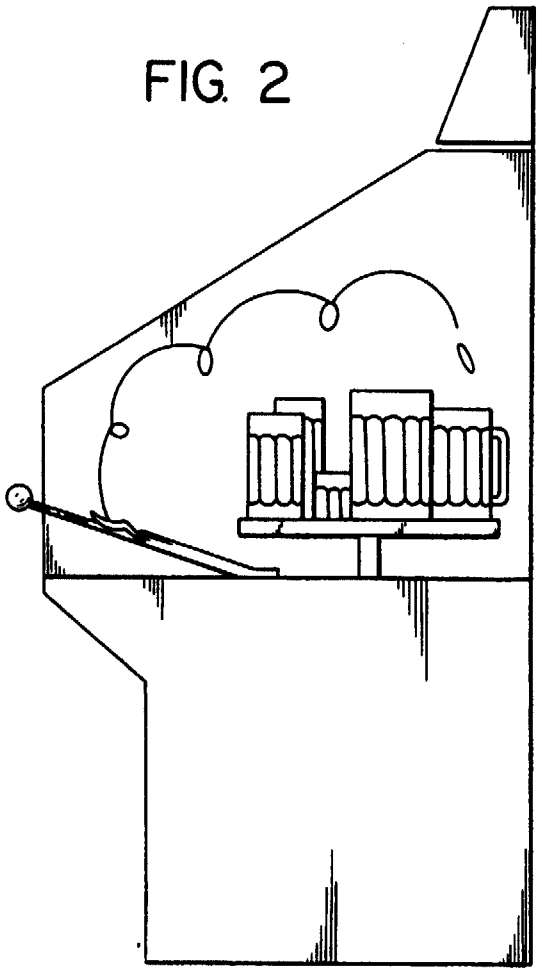
FIG. 2 is a side view of the catapult mechanism taken along line II—II of FIG. 1.

FIG. 2 illustrates a side view of the apparatus along section line II—II of FIG. 1. This arrangement does not show the coin entry mechanism or chute, and serves to illustrate the trajectory of the coin during play.

Figure 3:
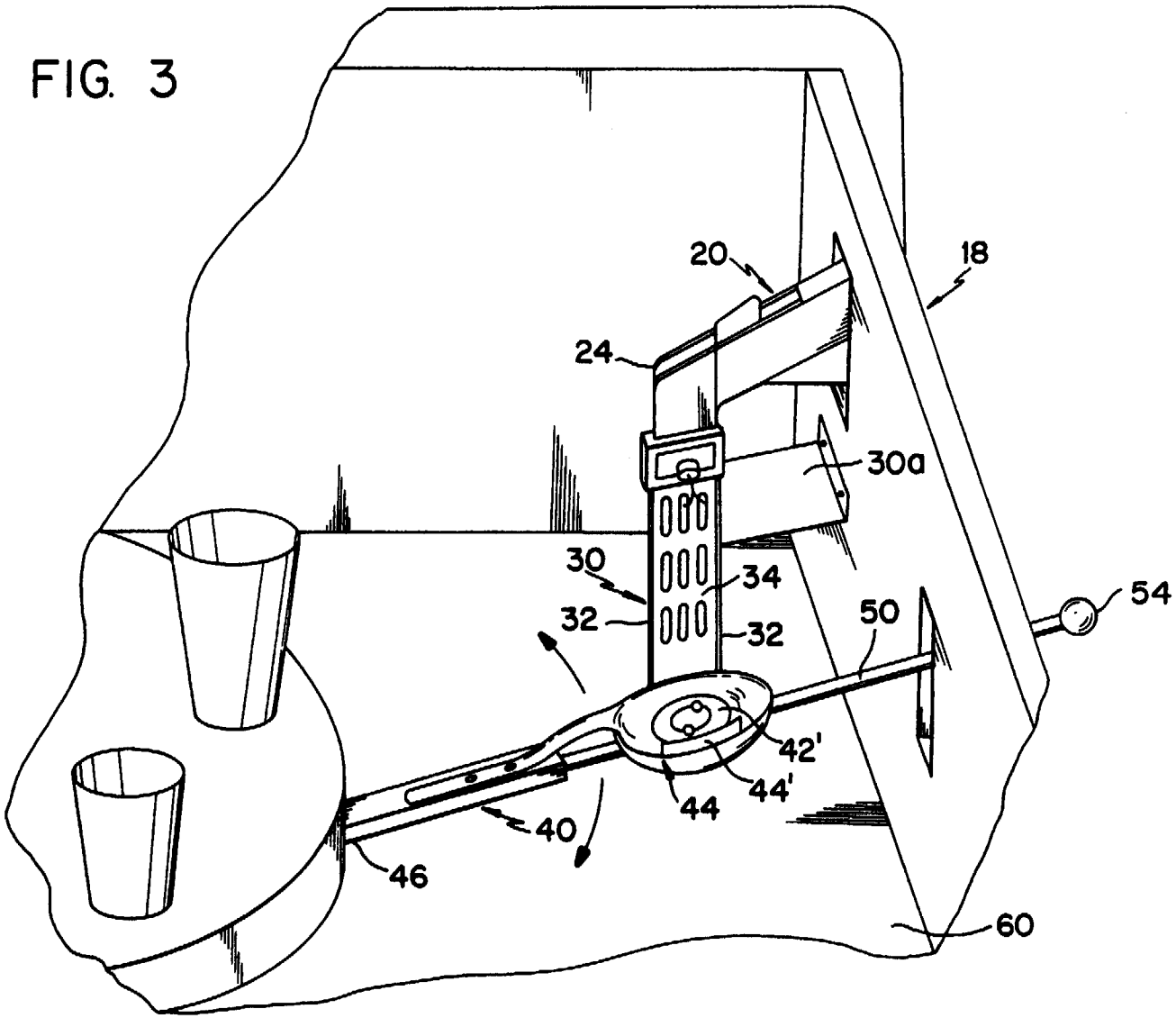
FIG. 3 illustrates the coin entry mechanism, the chute, and the catapult mechanism which forms the basis for the locating mechanism of the instant invention.

FIG. 3 is a perspective view of the coin entry mechanism 20, the chute 30 and the catapult mechanism 40 which forms the basis for the locating mechanism of the instant invention. The coin entry mechanism 20 receives a coin or token at the slot 18 (FIG. 1), which passes through a mechanical/electrical coin detector which detects incorrect coins by size, metal content or weight. An accepted coin triggers a switch to record the coin inserted in a particular coin slot on a respective meter housing and displayed at the display area 15 for example (FIG. 1*a*).

The coin entry mechanism 20 may take several forms in order to properly deliver the coin to the chute 30. In the preferred embodiment, the coin is oriented in the vertical direction for insertion into the slot 18. The coin entry mechanism 20 not only detects the correctness of the coin, but also orients the coin so as to lie flat on the chute 30. For the embodiment of FIG. 3, the coin orientation section 24 receives the coin in an upright, i.e. vertical, orientation and positions the coins on the chute 30 so as to lie flat for sliding thereon. However, the slot 18 may be oriented in an direction to ensure proper deliver to the coin entry mechanism 20.

Once the coin has been accepted, the chute 30 delivers the coin to the catapult mechanism, and in particular to the well section 42 which is formed to properly receive and position the coin for flipping. The dimensions of the well section 42 serves as a self aligning projectile receptacle. The top of the receiving section 44 serves as a funnel to receive the coin/token and places the same in proper horizontal orientation for flipping at the base of the well section 42. The well section 42 is slightly wider than the coin/token and allows them to be held in proper alignment.

It should be understood that the well 42 may be formed in any suitable manner to provide an aesthetic or popular design. The catapult mechanism illustrated in FIG. 3 provides a well 42 formed into a receiving section 44 in the shape of a spoon. It is contemplated however that the well 42 be formed into a variety of receiving sections, i.e. an artificial hand or a simple tray for ease of manufacture.

The receiving section 44 may also be provided with a stopper member or bumper 44' positioned on the receiving section at a position opposite the chute 30 so as to prevent the coin from overshooting or misaligning with the well 42.

The chute 30 is mounted within the playing area and supported by any suitable support, i.e. support plate 30*a*. The chute 30 is formed with walls 32 and slide base 34 which are oriented at an angle suitable for delivering the coin to the well 42. In the preferred embodiment, the chute is formed from stainless steel and oriented at an angle of approximately 30° from the horizontal direction. The orientation angle is chosen to ensure that the force of gravity on the coin overcomes the friction force between the coin and the chute. Providing slots in the slide base 34 also reduces the frictional resistance to allow coin-type objects to slide toward the receiving section 44 easier. The walls 32 maintain the coin on the slide base 34 as the coin is delivered to the well 42.

As shown in FIG. 3, the catapult 40 further comprises an arm member 46 to which is mounted the well section 42. The arm member 46 is mounted to the base board 60 so as to pivot in the vertical direction indicated by the arrows of FIG. 3. The specific pivot mechanism will be described below. The structural arrangement of the coin entry mechanism 20, the chute 30 and the catapult mechanism 40 forms the basis for the locating mechanism of the instant invention, which accurately and consistently delivers any coin inserted in the slot 18 to the well 42. The locating mechanism consistently receives and positions the coin in the horizontal direction on the well 42 such that the coin may be consistently flipped toward the targets provided in the playing area 8.

Figure 4:
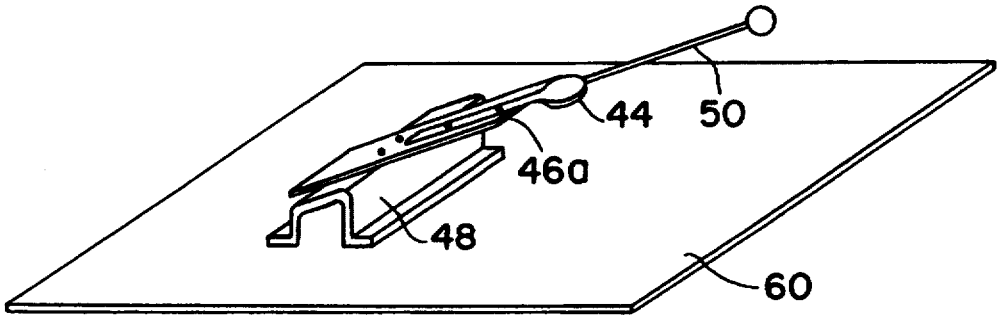
FIG. 4 is a perspective view of a pivot and launch spring mechanism for the instant invention according to a first embodiment utilizing a thin metal plate as part of the pivot arm.
Figure 5:
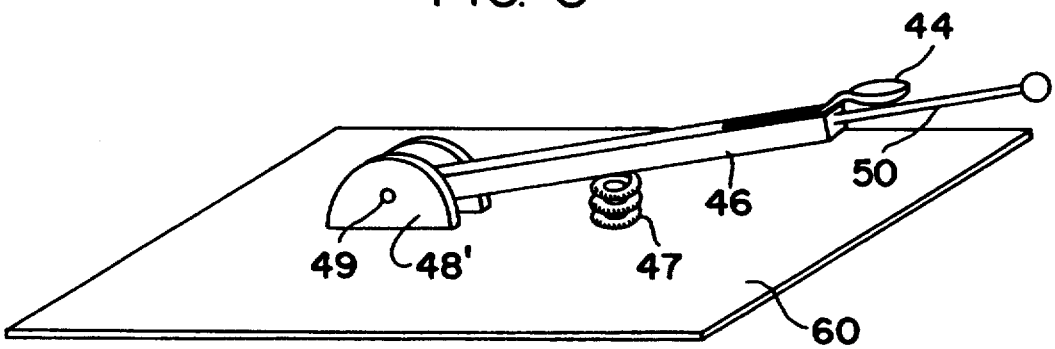
FIGS. 5 and 5*a* are perspective views of pivot and launch spring mechanisms for the instant invention according to a second embodiment utilizing a coil spring for resiliently acting on the pivot arm.
Figure 5A:
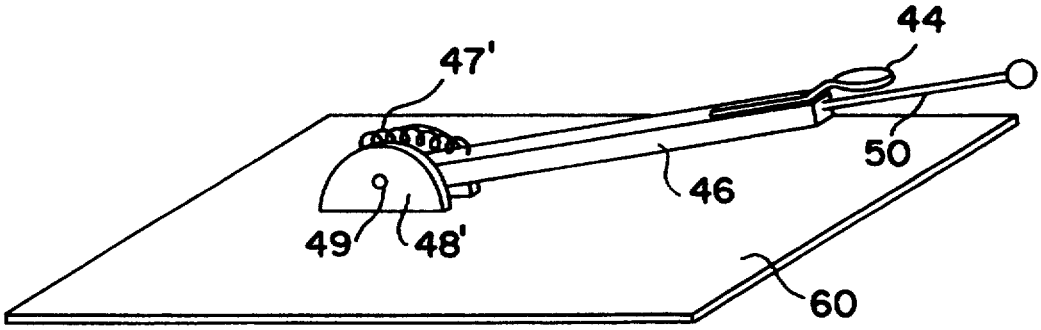

With reference to FIGS. 4, 5 and 5*a* description will now be given to the preferred pivot mechanisms for the instant invention.

The embodiment of FIG. 4 utilizes a thin metal plate 46*a* as part of the arm 46. The thin metal plate 46*a* is mounted to a baseplate 60 by means of a catapult base 48. The plate 46*a* is chosen to resiliently support the receiving section 44 whereby upon activation of the control rod 50, the receiving section 44 moves in a corresponding direction. When the control rod 50 is released, the receiving section 44 resiliently returns to its original position by the action of the thin metal plate 46*a* which acts similar to a leaf-spring when tensioned. This spring-like action serves to catapult a projectile positioned in the well 42 toward various targets in the playing area 8; following the trajectory illustrated in FIG. 2.

FIG. 5 illustrates another embodiment of the catapult mechanism wherein the arm 46 is pivotally attached to a baseplate 60 provided within the playing area 8. The arm 46 is pivotally supported to the baseplate 60 by arm support member 48' through pin 49. When the arm 46 is pivoted by activation of the control rod 50, the arm acts to compress the spring 47. The resilient force of the spring 47 is therefore applied to the arm causing a catapulting action of the arm 46 and receiving section 44.

FIG. 5*a* illustrates yet another embodiment of the catapult mechanism wherein the arm 46 is pivotally attached to a baseplate 60 provided within the playing area 8. The arm 46 is pivotally supported to the baseplate 60 by arm support member 48' through pin 49. When the arm 46 is pivoted by activation of the control rod 50, the arm acts to tension the spring 47'. The resilient force of the spring 47' is therefore applied to the arm causing a catapulting action of the arm 46 and receiving section 44.

Figure 6:
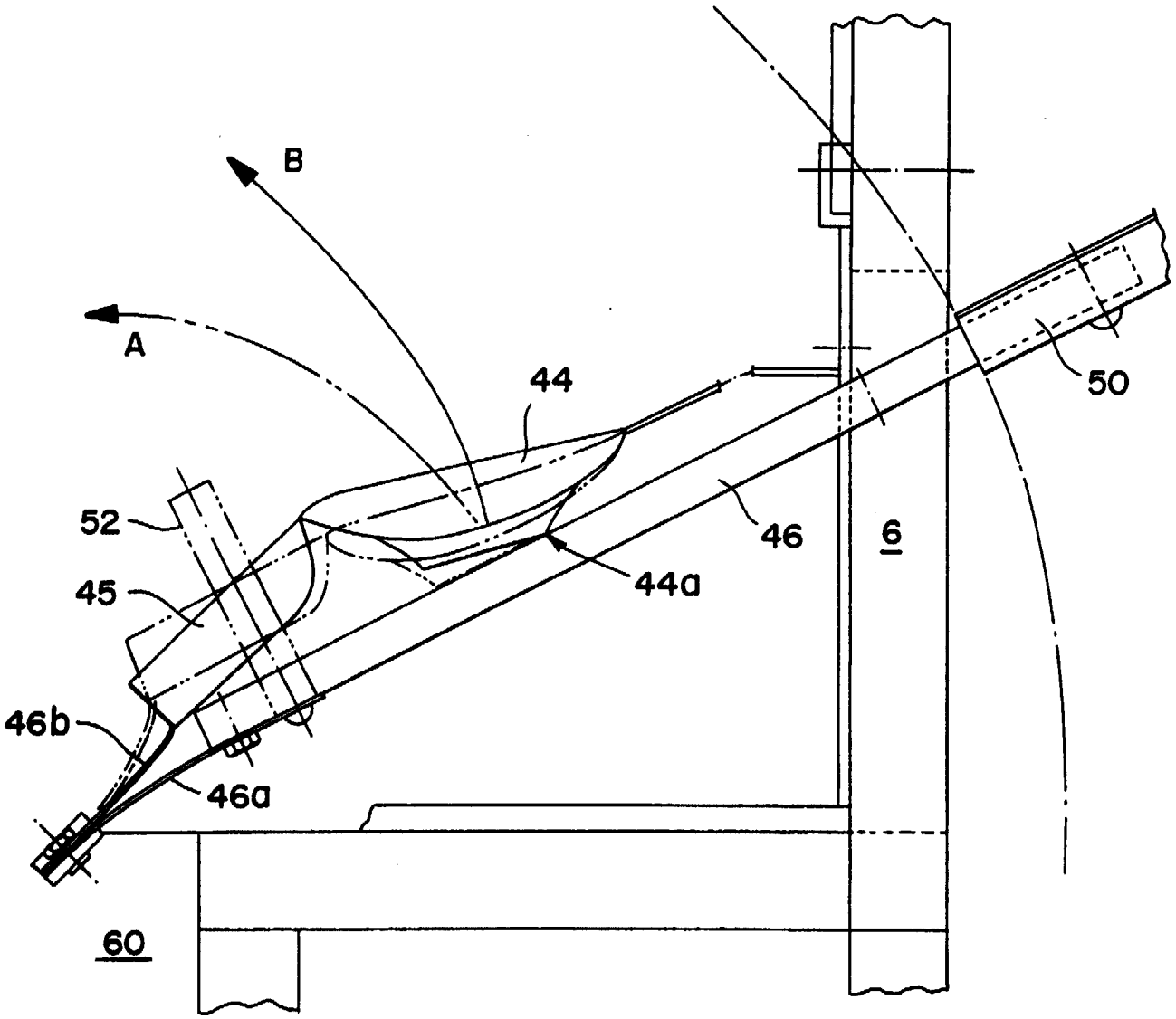
FIG. 6 is a side view of a pivot and launch spring mechanism according to a third embodiment utilizing both a keeper spring and a launch spring for varying the trajectory of the projectile.

FIG. 6 illustrates an alternate embodiment of the catapult mechanism of the invention whereby the projectile's angle of trajectory is controlled by the amount of displacement of the control rod 50. With the arrangement of FIG. 6, the projectile receiving section 44 (shown as a spoon head in FIG. 6) is mounted on the arm member 46 in a cantilevered manner so as to rest at a point 44*a* on the arm member 46. The catapult mechanism of FIG. 6 is provided with a launch spring 46*a* in a manner similar to the embodiment of FIG. 4 whereby the launch spring 46*a* supports the arm member 46 at one end and is fixed with respect to the baseplate 60 at it other end. In addition, the catapult mechanism is provided with a keeper spring 46*b* mounted to maintain the receiving section 44 at a predetermined angle with respect to the arm member 46 about which the receiving section 44 is positioned.

For the embodiment of FIG. 6, the keeper spring 46*b* maintains the receiving section 44 in an upright position (shown in solid lines). The upright position provides a high, short trajectory following the trajectory line B for targets that are relatively close to the catapult mechanism.

When the player desires to shoot at targets at a relatively distant position with respect to the catapult mechanism, the control rod 50 is pulled to attain greater displacement from the equilibrium condition. As the control rod 50 is released from this further position, the force of the keeper spring 46*b* is overcome by the force of the launch spring 46*a* and the receiving section 44 (spoon head in FIG. 6) is pivoted to the forward position (shown in dotted lines in FIG. 6). When the force of the keeper spring 46*b* is overcome by the force of the launch spring 46*a* in this manner, the projectile will follow a relatively low and distant trajectory as illustrated by the trajectory line A.

From the foregoing, it is understood that the centrifugal force generated by the motion of the arm member 46 causes the keeper spring 46*b* to change the angle of the receiving section 44, thus changing the angle of trajectory. The above described variable trajectory mechanism is not intended to limit the invention but rather provides the preferred embodiment for varying the angle of the receiving section 44 and consequently the trajectory based on the action or movement of the arm member 46.

The catapult mechanism of FIG. 6 is also provided with a rectangular guiding rod 52 which guides the movement of the receiving section 44 and keeper spring 46*b* with respect to the arm member 46 to ensure that the receiving section 44 is moved in the proper direction to toss the projectile. As illustrated in FIG. 6, the guiding rod 52 is mounted to the arm member 46 and passes through an intermediate member 45. This arrangement prevents unwarranted twisting or rocking of the receiving section 44 during the catapult motion.

It is to be understood that the catapult mechanism of the invention is not intended to be limited in any way by the embodiments illustrated herein. The invention is intended to encompass all catapult mechanisms which enable a player to selectively toss a coin toward a target provided within the playing area, wherein the coin is received in a well suitable formed to receive and position said coin.

In view of the foregoing, it is understood that the invention provides a simple yet reliable locating mechanism which receives and positions a coin or other object on a receiving section mounted on a catapult mechanism. A player then manually or electronically operates a control rod to selectively displace the control rod. When released, the control rod releases the catapult mechanism to project the coin toward target positioned in a playing area.

The control rod may be provided with a locking mechanism which allows the player to selectively displace the control rod to a desired position, then permitting the player to hold the rod at that position until release is desired. The locking mechanism may comprise a simple latch provided on adjacent the control rod and activated by the player. The player may separately release the latch so as not to disturb the catapulting action of the control rod and arm member.

While the foregoing invention has been particularly shown and described with reference to preferred embodiments, it will be understood by those having ordinary skill in the art that various changes in form and detail may be made therein without departing from the spirit and scope of the invention.

I claim:

1. A projecting and target apparatus for catapulting objects toward various targets provided in a playing area comprising:

a receiving means for receiving said objects to be catapult;

an object locating means for locating said objects to be catapulted on said receiving means;

a catapult means for tossing said objects toward a target area, said catapult means comprising a pivot arm which reversibly oscillates about a pivot point, said receiving means being mounted to said pivot arm, wherein said playing area is substantial closed and defines an outside area and an inside area, said locating means delivering said object from said outside area to said inside area.

2. The projectile and target apparatus of claim 1, further comprising a scoring means for recording successful tosses.

3. The projecting and target apparatus of claim 1, wherein said locating means comprises an acceptor means for receiving said object from a player, and a chute means for delivering said object to said receiving means.

4. The projecting and target apparatus of claim 3, wherein said acceptor means comprises a detector means for detecting various characteristics of said object.

5. The projecting and target apparatus of claim 1, wherein said object is disk shaped, and said receiving means is adapted to receive said object in a substantially horizontal position.

6. The projecting and target apparatus of claim 5, wherein said object slides along said locating means when delivered to said receiving means.

7. The projecting and target apparatus of claim 1, further comprising a control means for controlling a tossing force of said catapult means.

8. The projecting and target apparatus of claim 7, wherein said control means extends from said inside area to said outside area.

9. A projecting and target apparatus for catapulting objects toward various targets provided in a playing area comprising:

a receiving means for receiving said objects to be catapult;

an object locating means for locating said objects to be catapulted on said receiving means;

a catapult means for tossing said objects toward a target area, wherein said playing area is substantial closed and defines an outside area and an inside area, said locating means delivering said object from said outside area to said inside area;

a control means for controlling a tossing force of said catapult means, wherein said control means extends from said inside area to said outside area and wherein said control means is affixed to said catapult means for manually controlling a pivoting motion of said catapult means.

10. A coin projecting and target apparatus for catapulting coins toward various targets provided in a playing area comprising:

a receiving means for receiving said coins to be catapult;

a coin locating means for locating said coins on said receiving means;

a catapult means for tossing said coins toward a target area, said catapult means comprising a pivot arm which reversibly oscillates about a pivot point, wherein said receiving means is positioned on said catapult means so as to receive said coins in a substantially horizontal position.

11. The coin projecting and target apparatus of claim 10, wherein said locating means comprises a coin entry means for receiving said coin from a player and a chute for delivering said coin to said receiving means.

12. The coin projecting and target apparatus of claim 11, wherein said coin slides along said chute from said coin entry means to said receiving means.

13. The coin projecting and target apparatus of claim 10, wherein said receiving means comprises a depression formed to receive said coin in a suitable manner for tossing.

14. The coin projecting and target apparatus of claim 10, wherein said receiving means comprises a bumper means for preventing a misalignment of said coin, said bumper means being positioned at a location on said receiving means opposite said chute.

15. The coin projecting and target apparatus of claim 10, further comprising a control means for manually controlling a tossing force of said catapult means, and a delay between discrete tossing operations.

16. The projecting and target apparatus of claim 15, wherein said playing area is substantial closed and defines an outside area and an inside area, said control means extends from said inside area to said outside area.

17. The coin projecting and target apparatus of claim 10, wherein said catapult means comprises a resilient member acting on said receiving means thereby causing a tossing motion.

18. A coin projecting and target apparatus for catapulting coins toward various targets provided in a playing area comprising:

a receiving means for receiving said coins to be catapult;

a coin locating means for locating said coins on said receiving means;

a catapult means for tossing said coins toward a target area, wherein said receiving means is positioned on said catapult means so as to receive said coins in a substantially horizontal position a control means for controlling a tossing force of said catapult means, wherein said control means is affixed to said catapult means for manually controlling a pivoting motion of said catapult means.

19. A projecting and target apparatus for catapulting a projectile toward targets provided in a playing area comprising:

a lever means for manually varying a catapult force with which said projectile is catapulted;

a receiving means for receiving said projectile to be catapult, said receiving means being positioned on said lever means;

a projectile locating means for locating said coins on said receiving means;

a catapult means for catapulting said projectile toward a target area; and trajectory adjustment means for varying the trajectory of said projectile, said adjustment means varying the position of said receiving means with respect to said lever means.

20. The coin projecting and target apparatus of claim 19, wherein said receiving means is pivotally mounted on said lever means.

21. The coin projecting and target apparatus of claim 19, wherein said catapult means comprises a first resilient means for resiliently supporting said lever means to a support, and a second resilient means for varying a position of said receiving means with respect to said lever means.

22. The coin projecting and target apparatus of claim 21, wherein said second resilient means varies said position in response to a movement of said lever means.

23. The coin projecting and target apparatus of claim 19, further comprising guide means for guiding a movement of said receiving means with respect to said lever means.

* * * * *